US010344547B2

(12) United States Patent
Leuchtenberg et al.

(10) Patent No.: US 10,344,547 B2
(45) Date of Patent: Jul. 9, 2019

(54) APPARATUS FOR CONTINUOUS CIRCULATION DRILLING OF A WELLBORE

(71) Applicant: MANAGED PRESSURE OPERATIONS PTE. LTD., Singapore (SG)

(72) Inventors: Christian Leuchtenberg, Singapore (SG); Rae Younger, Ellon (GB)

(73) Assignee: MANAGED PRESSURE OPERATIONS PTE. LTD., Singapore (SG)

( * ) Notice: Subject to any disclaimer, the term of this patent is extended or adjusted under 35 U.S.C. 154(b) by 274 days.

(21) Appl. No.: 14/436,783

(22) PCT Filed: Oct. 17, 2013

(86) PCT No.: PCT/GB2013/052712

§ 371 (c)(1),
(2) Date: Apr. 17, 2015

(87) PCT Pub. No.: WO2014/060759

PCT Pub. Date: Apr. 24, 2014

(65) Prior Publication Data

US 2015/0285015 A1 Oct. 8, 2015

(30) Foreign Application Priority Data

Oct. 18, 2012 (GB) ..... 1218729.0

(51) Int. Cl.
*E21B 21/12* (2006.01)
*E21B 21/10* (2006.01)
*E21B 19/16* (2006.01)

(52) U.S. Cl.
CPC ..... *E21B 21/12* (2013.01); *E21B 19/16* (2013.01); *E21B 21/106* (2013.01)

(58) Field of Classification Search
CPC ..... E21B 21/106; E21B 19/16; E21B 21/10; E21B 21/12
See application file for complete search history.

(56) References Cited

U.S. PATENT DOCUMENTS 2,158,356 A 5/1939 Dyer
4,981,180 A * 1/1991 Price ..... E21B 3/02 173/164

(Continued)

FOREIGN PATENT DOCUMENTS

CN 101611215 A 12/2009
CN 101942977 A 1/2011

(Continued)

*Primary Examiner* — Kipp C Wallace
(74) *Attorney, Agent, or Firm* — Norman B. Thot

(57) ABSTRACT

An apparatus for continuous circulation drilling comprising a tubular body having a main passage extending along a longitudinal axis of the tubular body from a first end of the tubular body to a second end of the tubular body, a side passage and a control passage, the side passage and control passage both extending through the tubular body into the main passage, the tubular body containing a valve assembly which is operable to close the main passage when the side passage is open and to close the side passage when the main passage is open, the assembly further comprising a hydraulic connector which is operable to clamp around the tubular body, the connector comprising a housing with an interior surface which is provided with first and second grooves which, when the connector is clamped around the tubular body, each form a channel which extends in continuous loop around the exterior of the tubular body, there being at least one passage extending through the housing from an exterior surface of the housing into each of the channels, wherein the tubular body is further provided with two grooves which extend around an exterior surface of the body so that, when the connector is clamped around the tubular body, the (Continued)

Figure 1:
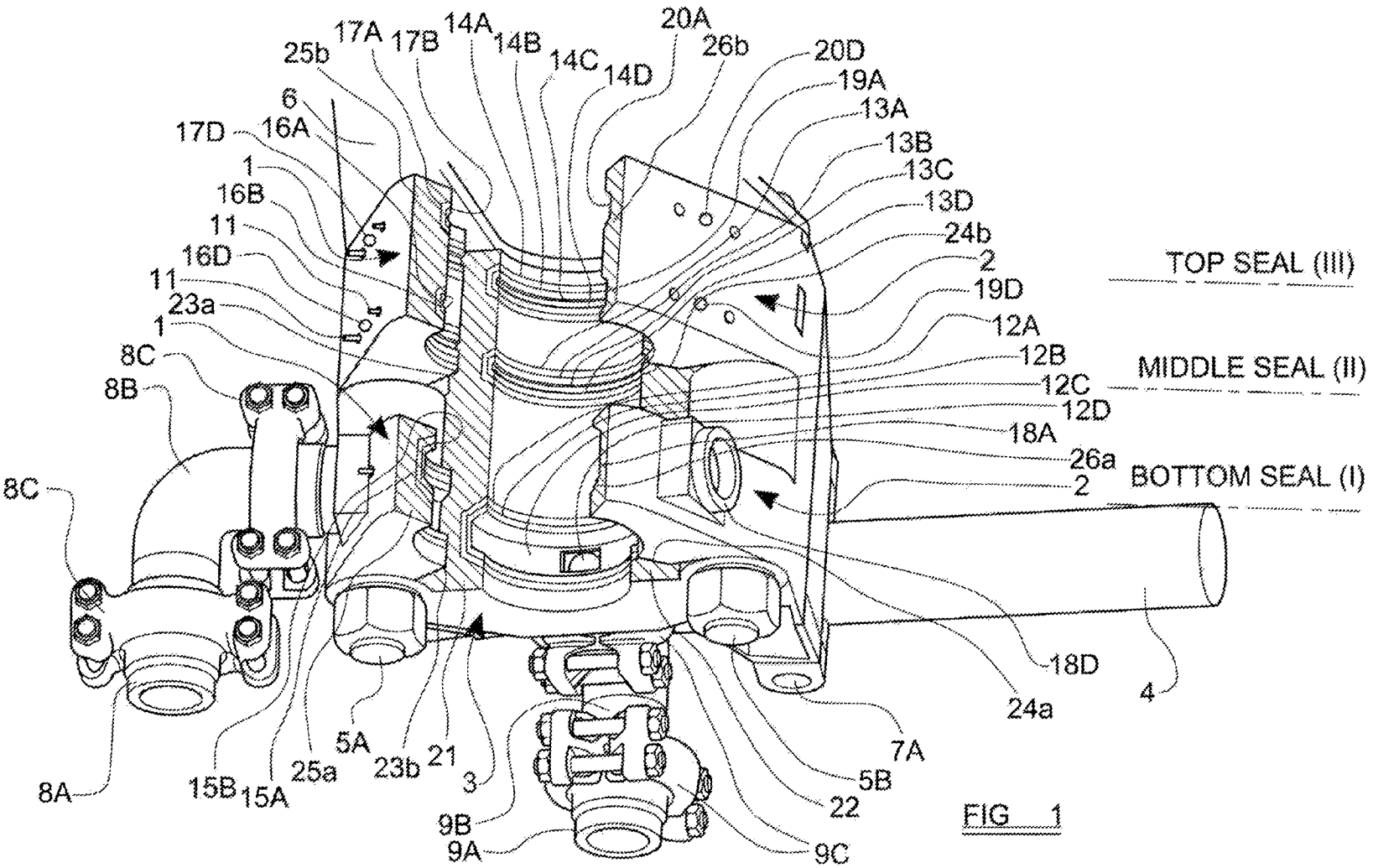

connector housing engages with the grooves, the grooves thus restricting longitudinal movement of the connector relative to the tubular body, and the side passage and control passage each connect the main passage with one of the channels formed by the connector.

15 Claims, 6 Drawing Sheets

(56) References Cited

U.S. PATENT DOCUMENTS

| | | | | |
|---|---|---|---|---|
| 7,007,753 | B2 * | 3/2006 | Robichaux | E21B 17/05 166/177.4 |
| 7,281,582 | B2 * | 10/2007 | Robichaux | E21B 33/14 166/177.4 |
| 8,844,653 | B2 * | 9/2014 | deBoer | E21B 17/00 166/334.4 |
| 2003/0150647 | A1 * | 8/2003 | Mason | E21B 19/10 175/203 |
| 2004/0003490 | A1 * | 1/2004 | Shahin | E21B 19/16 29/464 |
| 2005/0092500 | A1 * | 5/2005 | Otten | E21B 19/06 166/380 |
| 2007/0131416 | A1 * | 6/2007 | Odell, II | E21B 19/06 166/250.1 |
| 2008/0135228 | A1 | 6/2008 | Wells et al. | |
| 2009/0025930 | A1 | 1/2009 | Iblings et al. | |
| 2009/0242817 | A1 | 10/2009 | Strazhgorodskiy | |
| 2010/0155143 | A1 | 6/2010 | Braddick | |
| 2011/0203670 | A1 | 8/2011 | Braddick | |
| 2011/0308860 | A1 | 12/2011 | deBoer | |
| 2012/0090853 | A1 | 4/2012 | Leuchtenberg et al. | |
| 2013/0068532 | A1 * | 3/2013 | Bansal | E21B 21/10 175/218 |

FOREIGN PATENT DOCUMENTS

| | | | |
|---|---|---|---|
| CN | 102378847 | A | 3/2012 |
| WO | WO 2005/019596 | A1 | 3/2005 |
| WO | WO 2009/022914 | A1 | 2/2009 |
| WO | WO 2009/093069 | A2 | 7/2009 |
| WO | WO 2010/046653 | A2 | 4/2010 |
| WO | WO 2010/112933 | A2 | 10/2010 |
| WO | WO 2011/159983 | A1 | 12/2011 |
| WO | WO 2010/010480 | A2 | 1/2012 |
| WO | WO 2012/085597 | A2 | 6/2012 |

* cited by examiner

APPARATUS FOR CONTINUOUS CIRCULATION DRILLING OF A WELLBORE

The present invention relates to an apparatus for use in continuous circulation drilling of a wellbore, in particular to a hydraulic connector and sub assembly for the connection of hydraulic lines to side ports in a drill string.

Subterranean drilling typically involves rotating a drill bit from surface or on a downhole motor at the remote end of a tubular drill string. It involves pumping a fluid down the inside of the tubular drillstring, through the drill bit, and circulating this fluid continuously back to surface via the drilled space between the hole/tubular, referred to as the annulus. This pumping mechanism is provided by positive displacement pumps that are connected to a manifold which connects to the drillstring, and the rate of flow into the drillstring depends on the speed of these pumps. The drillstring is comprised of sections of tubular joints connected end to end, and their respective outside diameter depends on the geometry of the hole being drilled and their effect on the fluid hydraulics in the wellbore. The drillstring ends are connected by a thicker material larger diameter section of the joint—located at both ends of the section—called tool joints.

Tool joints provide high-strength, high pressure threaded connections that are sufficiently robust to survive the rigors of drilling and numerous cycles of tightening and loosening at the drill pipe connections. The large diameter section of the tool joints provides a low stress area where rig pipe tongs are used to grip the pipe to either make up or break apart the connection of two separate sections of drill pipe.

Mud is pumped down the drill string utilizing the mud pumps which circulates through the drill bit, and returns to the surface via the annulus. For a subsea well bore, a tubular, known as a riser extends from the rig to the top of the wellbore which exists at subsea level on the ocean floor. It provides a continuous pathway for the drill string and the fluids emanating from the well bore. In effect, the riser extends the wellbore from the sea bed to the rig, and the annulus also comprises the annular space between the outer diameter of the drill string and the riser.

The entire drillstring and bit are rotated using a rotary table, or using an above ground motor mounted on the top of the drill pipe known as a top drive.

The bit penetrates its way through layers of underground formations until it reaches target prospects—rocks which contain hydrocarbons at a given temperature and pressure. These hydrocarbons are contained within the pore space of the rock (i.e. the void space) and can contain water, oil, and gas constituents—referred to as reservoirs. Due to overburden forces from layers of rock above, these reservoir fluids are contained and trapped within the pore space at a known or unknown pressure, referred to as pore pressure. An unplanned inflow of these reservoir fluids is well known in the art, and is referred to as a formation influx or kick and commonly called a well control incident or event.

A fluid of a given density fills and circulates the annulus of the drilled hole. The purpose of this drilling fluid/mud is to lubricate, carry drilled rock cuttings to surface, cool the drill bit, and power the downhole motor and other tools. Mud is a very broad term and in this context it is used to describe any fluid or fluid mixture that covers a broad spectrum from air, nitrogen, misted fluids in air or nitrogen, foamed fluids with air or nitrogen, aerated or nitrified fluids, to heavily weighted mixtures of oil and water with solids particles. Most importantly this fluid and its resulting hydrostatic pressure—the pressure that it exerts at the bottom of the hole from its given density and total vertical height/depth—prevent the reservoir fluids at their existing pore pressure, described herein, from entering the drilled annulus. The drilling fluid must also exert a pressure less than the fracture pressure of the formation, which is where fluid will be forced into the rock as a result of pressure in the wellbore exceeding the formation's horizontal stress forces.

The bottom hole pressure (BHP) exerted by the hydrostatic pressure of the drilling fluid is the primary barrier for preventing influx from the formation. BHP can be expressed in terms of static BHP or dynamic/circulating BHP. Static BHP relates to the BHP value when the mud pumps are not in operation. Dynamic or circulating BHP refers to the BHP value when the pumps are in operation during drilling or circulating.

Equivalent circulating density (ECD) is the increase in bottom hole pressure (BHP) expressed as an increase in pressure that occurs only when drilling fluid is being circulated. This pressure is different to the hydrostatic pressure as the ECD calculation and value reflect the total friction losses in the annulus from the point of fluid exiting the bit at the wellbore bottom to surface as it flows up the annulus. The ECD can result in a bottom hole pressure that varies from being slightly to significantly higher than the bottom hole pressure when the drilling fluid is not being pumped through the system. The ECD is related to the circulating or drilling BHP in the sense that the ECD is calculated from the BHP. The ECD is directly related to the friction losses that are occurring along the entire length of the wellbore.

As drilling progresses pipe has to be connected to the existing drillstring to drill deeper. Conventionally, this involves shutting down fluid circulation completely so the pipe can be connected into place as the top drive has to be disengaged. Once the connection is complete, circulation is reestablished—a procedure than can take up to 2 minutes or longer, which leaves the annulus in a static state. Stopping mud flow in the middle of the drilling process is time consuming and problematic for a number of reasons, such as inducing a kick due to the decrease in the ECD and BHP at the bottom of the well when the pumps are ceased, and stuck pipe from solids settling out of the static drilling fluid.

In deeper and more complex wellbores, referred to as HPHT or Ultra HPHT (high pressure high temperature) wells, bottom hole temperatures ranging from 300° F. (149° C.) to 400° F. (200° C.) and a pore pressures ranging from 10,000 to 20,000 psi and beyond are possible. In these environments, any disruption to the continuous flow of drilling fluid within the drillstring and annulus will result in large variances in the drilling fluid properties in the annulus during static periods. The high temperatures alter density and viscosity properties of the drilling fluid during static periods, resulting in a variance in the ECD throughout the annulus and drill pipe upon recommencing circulation which can induce a kick. This also will change circulating pressures initially and mask any pressure changes in the system which may be formation related. Additionally, by stopping circulation to make a connection with these wells, due to the extremely high bottom hole pressures there is a high level of risk which exists for a kick to occur due to the decrease in the ECD and BHP once the pumps are stopped and circulation is ceased.

Methods have been designed and implemented to facilitate continuous pumping of mud through the drill string by the provision of a side passage, typically in each section of drill string. This means that mud can be pumped into the drill string via the side passage while the top of the drill string is closed—the top drive can be disconnected and the new section of drill string being connected while maintaining circulation.

In one such system, disclosed in U.S. Pat. No. 2,158,356, at the top of each section of drill string, there is provided a side passage which is closed using a plug, and a valve member which pivots between a first position, in which the side passage is closed while the main axial passage of the drill string is open—and a second position in which the side passage is open while the main upper axial passage is closed. During drilling, the valve is retained in the first position, but when it is time to increase the length of the drill string, the plug is removed from the side passage, and a hose, which extends from the pump, connected to the side passage, and a valve in the hose opened so that pumping of mud into the drill string via the side passage commences. A valve in the main hose from the pump to the top of the drill string is then closed, and the pressure of the mud at the side passage causes the valve member to move from the first position to the second position, and hence to close the main passage of the drill string.

The main hose is then disconnected, the new section of tubing mounted on the drill string, and the main hose connected to the top of the new section. The valve in the main hose is opened so that pumping of mud into the top of the drill string is recommenced, and the valve in the hose to the side passage closed. The resulting pressure of mud entering the top of the drill string causes the valve member to return to its first position, which allows the hose to be removed from the side passage, without substantial leakage of mud from the drill string.

This process is commonly referred to as continuous circulation drilling.

In another system, disclosed in WO 2010/046653 A2 and PCT/GB2010/050571, an improved design for achieving continuous circulation is described. A valve member is installed in the main bore of the drill pipe and engages with the internal wall of the drill pipe. In this configuration, an internal sleeve comprised of an aperture and an internal bore size near the main bore size of the drill pipe will be installed in the main bore of the drill pipe. The sleeve's aperture will provide a flow orifice when the sleeve is rotated and aligned with the side port/bore in the drill pipe wall. When the aperture within the sleeve is aligned with the side port bore, this is the "open" position and flow through the side bore and into the main bore of the drill pipe is permitted. With the sleeve rotated to the "closed" position, the aperture will align with the drill pipe body and flow will be prevented into the side port and main bore of the drill pipe. The rotation of the internal sleeve is performed via an internal intermeshing cam and gear wheel assembly using external pivotal motion done manually at the external surface of the drill pipe, thus allowing the sleeve to be pivoted between the open and closed positions. The internal sleeve rotates concentrically within the stationary drill pipe via this mechanical assembly.

Alternatively the valve member is located in the side port of the drill pipe, with various possible positions within the side bore. In this configuration a spring assembly is utilized, installed within the side port and actuated by fluid pressure, and secured within the internal wall of the side bore. In its stationary closed position, the spring tension seats the valve member within the side port and the main bore drill pipe fluid pressure during drilling will impose force the valve member against the seat—flow will not be permitted. When fluid pressure is introduced into the side bore of the apparatus, the pressure will build until it is equal or greater to the main bore drill pipe pressure and the spring compresses—the valve member is forced away from the seat and flow is then permitted through the side port and into the main bore of the drill pipe.

The connector for this system delivers the fluid supply to the side port by mechanically locking the connector to the side port of the sub. On one of the 2 "free" ends of the connector body, the high pressure mud hose is attached, which is connected to the conduit network supplied by the mud pump to deliver fluid to the connector assembly. The other "free" end of the connector assembly consists of the drill pipe connector body, which is comprised of a series of step-down profiles referred to as bayonet-type formations. This will mechanically lock the connector assembly into place when it is inserted into the valve insert located in the side port of the sub. The internal profile of the side port valve is tapered to accommodate the bayonet formation of the drill pipe connector body, and its contour consists of a series of lip formations near its external edge (i.e. towards the external edge of the sub). The purpose of the lip profile is to engage and lock the series of bayonet formations on the drill pipe connector body into place within the lip formations of the valve insert.

To attach the connector assembly to the side port of the drill pipe/sub, the bayonet formation is inserted into the internal profile of the side port bore of the continuous circulation sub. The handle of the connector assembly is used to rotate the drill pipe connector body to align it with the lip formations of the valve insert such that the bayonet profile slides between the spaces of these lips. The bayonet moves inwards until it reaches a "no-go" shoulder in the valve insert—at this point the handle is used to rotate and engage the bayonet profile within the lip formation of the valve insert. A pin assembly latches the bayonet, providing a mechanical stop which will prevent the drill pipe connector body from being removed. An additional mechanism of the connector assembly, referred to as the torque wheel, is turned via another external handle to push a series of locking pins from the connector assembly inwards towards the valve insert. These lock into place within locking bores in the side port, securing the entire connector assembly and preventing rotation of the drill pipe connector body within the valve insert.

Flow and fluid pressure through the side port is initiated by a valve actuator rod which exists internally within the connector, and this is operated manually by an operator to move the valve member to its open position.

The procedures for all the systems above for engaging the connector and establishing continuous circulation are performed manually by an operator and therefore carries with it inherent operational risks. The operator is exposed to high pressure lines, high volume fluid flow, and potential physical injury from manually handling heavy equipment.

Additionally, with the above systems, if any unplanned or accidental drillstring rotation occurs the connector assembly and the hose connected to the high pressure fluid delivery system will create a whipping motion on the rig floor and be exposed to excessive torque forces. There may be a rupture or failure in the fluid delivery system of the connector as this hose breaks apart, which could expose personnel to high pressure high flow rate drilling fluid. There have been occurrences of such an event in land based drilling operations utilizing these continuous circulation connector and sub designs.

A sub and hydraulic connector apparatus for use in continuous circulation has been disclosed in patent applications WO 2011/159983 (PCT/US2011/040829) and US 2011/0308860. In this system, the valves in the sub are remotely operable by means of hydraulic fluid supplied to the sub via the connector.

Patent application no. PCT/GB2011/052579, also describes a hydraulically operable continuous circulation sub and its internal valve system designated for continuous circulation in offshore drilling operations, referred to herein as the OCD. This continuous circulation sub (OCD sub) comprises longitudinal main flow passage, an internal hydraulically actuated sliding sleeve, and a main ball valve which is located in the main flow passage and which movable to prevent flow of fluid through the drill pipe and drilling annulus during connection periods. The sleeve is moved longitudinally along the sub by the supply of fluid pressure through one of two ports, which will move the sleeve towards or away from a main axial ball valve. The ball valve is configured such that an index pin moves into an index surface of the ball as the sleeve moves towards the ball valve. The motion of the index pin within tracks of the index surface of the ball valve, combined with the movement of the sliding sleeve, rotates the main ball valve member to either open or closed positions to isolate the top drive above so a connection can be performed. Thus, the sleeve acts as a hydraulic actuator to effect movement of the main ball valve to open or close the main flow passage in the OCD sub.

The sleeve itself also acts as a valve member as it is movable to open or close one or more side ports in the OCD sub. The sleeve and ball valve are configured such that when the main ball valve member is closed, the side port(s) is open to allow circulation to enter through the side port(s) via a hydraulic connector assembly which is hydraulically engaged to the OCD and connected to the rig mud pump system. The sliding sleeve will seal or expose the side port(s) with the sliding motion and position of the internal sleeve, as it simultaneously opens or closes the main ball valve assembly.

The connector described in this application was designed to be used in conjunction with the OCD sub described in PCT/GB2011/052579, and will therefore be described in conjunction with this OCD sub. It should be appreciated, however, that the connector could, equally, be used in connection with other OCD sub designs, such as the ones described in WO 2011/159983 and US 2011/0308860.

This hydraulic connector apparatus is designed to address the safety issue of unplanned or accidental drill pipe rotation which can occur during a connection period while the drill pipe hangs in the slips in the rotary table.

According to a first aspect of the invention we provide a continuous circulation drilling apparatus comprising a tubular body having a main passage extending along a longitudinal axis of the tubular body from a first end of the tubular body to a second end of the tubular body, a side passage and a control passage, the side passage and control passage both extending through the tubular body into the main passage, the tubular body containing a valve assembly which is operable to close the main passage when the side passage is open and to close the side passage when the main passage is open, the assembly further comprising a hydraulic connector which is operable to clamp around the tubular body, the connector comprising a housing with an interior surface which is provided with first and second grooves which, when the connector is clamped around the tubular body, each form a channel which extends in continuous loop around the exterior of the tubular body, there being at least one passage extending through the housing from an exterior surface of the housing into each of the channels, wherein the tubular body is further provided with at least one groove which extends around an exterior surface of the body so that, when the connector is clamped around the tubular body, the connector housing engages with the groove, the groove thus restricting longitudinal movement of the connector relative to the tubular body, and the side passage and control passage each connect the main passage with one of the channels formed by the connector.

In one embodiment, the groove extends in a loop around the entire circumference of the tubular body.

The groove in the tubular body thus acts as a guide to ensure correct alignment of the connector relative to the tubular body so that the connector can provide a means of supply of fluid to the main passage in the tubular body via the side passage or control passage.

The valve assembly may comprise a rotating valve member which is rotatable to open or close the main passage in the tubular body. In this case, the valve assembly may comprise a sliding sleeve which is located in the main passage of the tubular body and which is movable generally parallel to the longitudinal axis of the tubular body by the supply of pressurised fluid to the control port, the sliding sleeve being connected to the rotating valve member so that such longitudinal movement of the sliding sleeve causes the rotating valve member to rotate. During this longitudinal movement, the sliding sleeve may move from a first position in which it closes the side passage in the tubular body, and a second position in which the side passage is open.

The apparatus is preferably provided with sealing elements which, when the connector is clamped around the tubular body, form a substantially fluid tight seal between the connector and the tubular body. In this case, preferably the sealing elements form at least three seals, each of which forms a continuous loop around the tubular body, the first seal lying between the first end of the tubular body and the control passage, the second seal lying between the control passage and the side passage, and the third seal lying between the side passage and the second end of the tubular body. In this way, the seals should prevent fluid leaking from the channels formed by the connector around the tubular body.

The tubular body may be provided with a further control passage which extends through the tubular body into the main passage, and the interior surface of the connector may be provided with a third groove which, when the connector is clamped around the tubular body, forms a third channel which extends in continuous loop around the exterior of the tubular body. In this case, preferably sealing elements are provided to form at least four seals, each of which forms a continuous loop around the tubular body, the first seal lying between the first end of the tubular body and the first control passage, the second seal lying between the first control passage and the second control passage, the third seal lying between the second control passage and the side passage, and the fourth seal lying between the side passage and the second end of the tubular body.

The sealing elements may include at least one seal insert which lines one of the grooves in the interior surface of the connector.

The connector housing may comprise three sections, the first two of which are pivotally mounted on the third. In this case, the housing sections are each provided with sealing surfaces which, when the connector is clamped around the tubular body, engage with sealing surfaces of an adjacent housing section to ensure a substantially fluid tight seal between adjacent housing sections. The connector may be provided with an actuator for pivoting the first two housing sections relative to the third housing section. This actuator may comprise a hydraulically operated piston and cylinder.

According to a second aspect of the invention we provide a continuous circulation drilling apparatus comprising a tubular body having a main passage extending along a longitudinal axis of the tubular body from a first end of the tubular body to a second end of the tubular body, a side passage and a control passage, the side passage and control passage both extending through the tubular body into the main passage, the tubular body containing a valve assembly which is operable to close the main passage when the side passage is open and to close the side passage when the main passage is open, the assembly further comprising a hydraulic connector which is operable to clamp around the tubular body, the connector comprising a housing with an interior surface which is provided with first and second grooves which, when the connector is clamped around the tubular body, each form a channel which extends in continuous loop around the exterior of the tubular body, there being at least one passage extending through the housing from an exterior surface of the housing into each of the channels, wherein the connector housing comprises three sections, the first two of which are pivotally mounted on the third.

Figure 2:
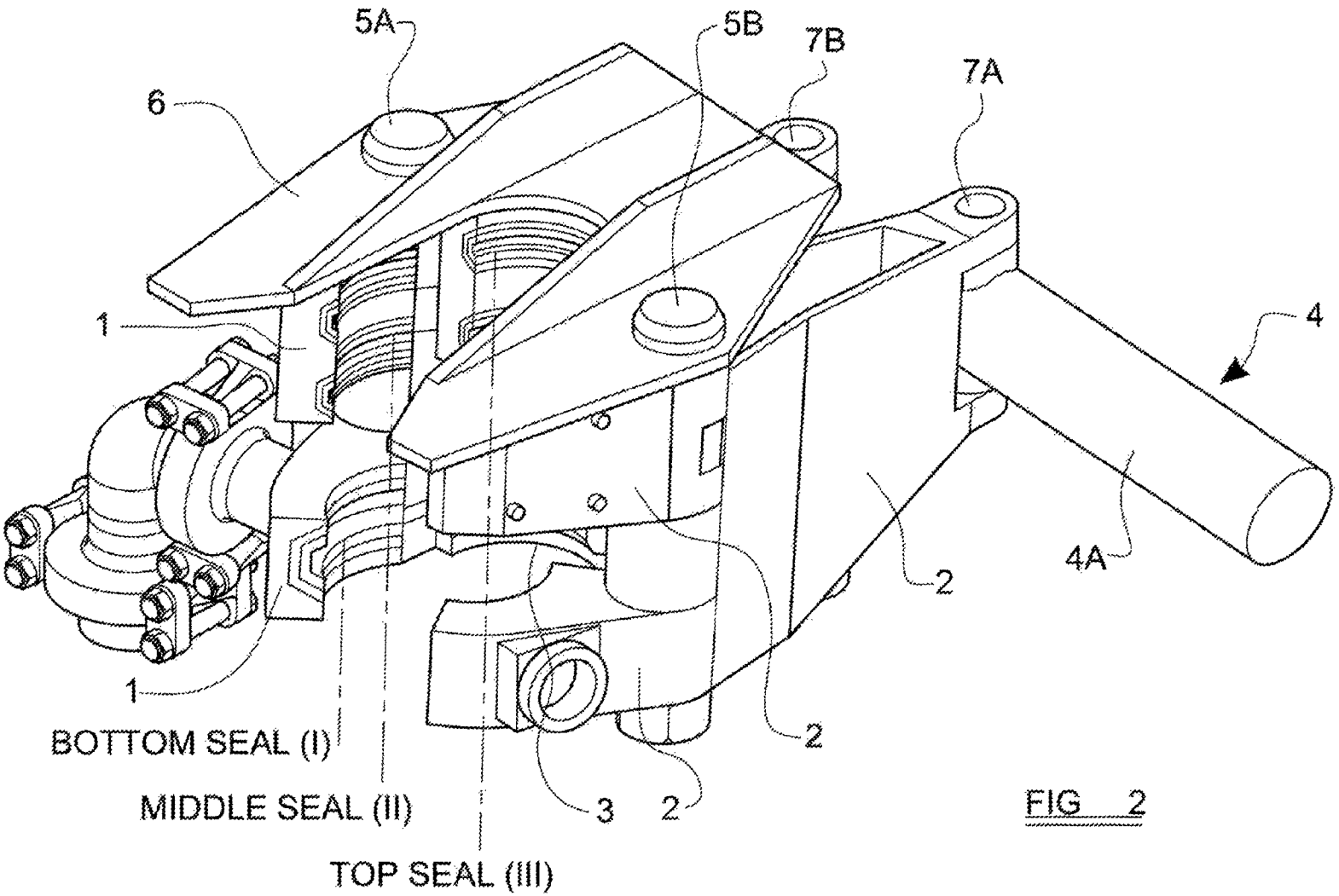
Figure 3:
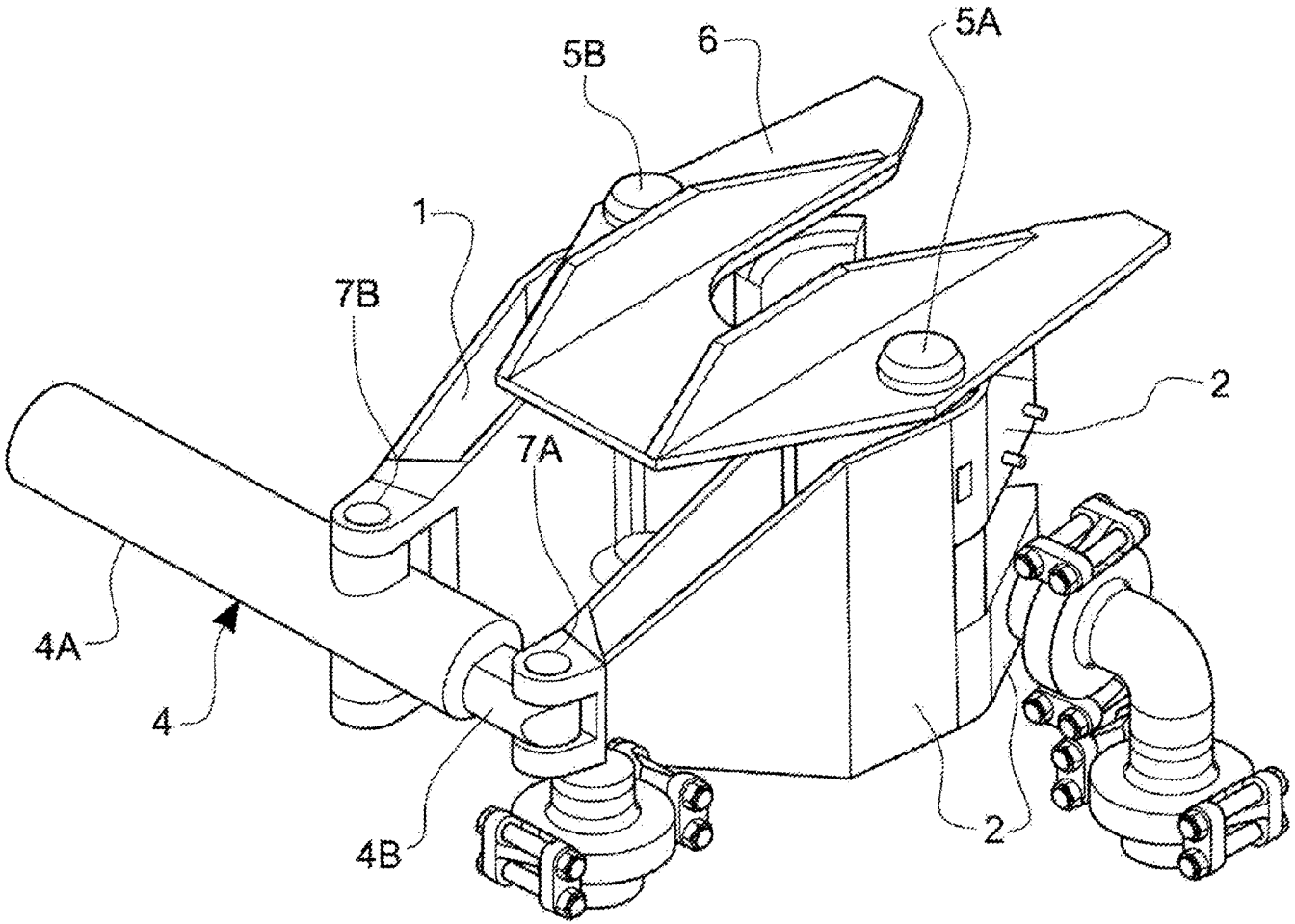
Figure 4:
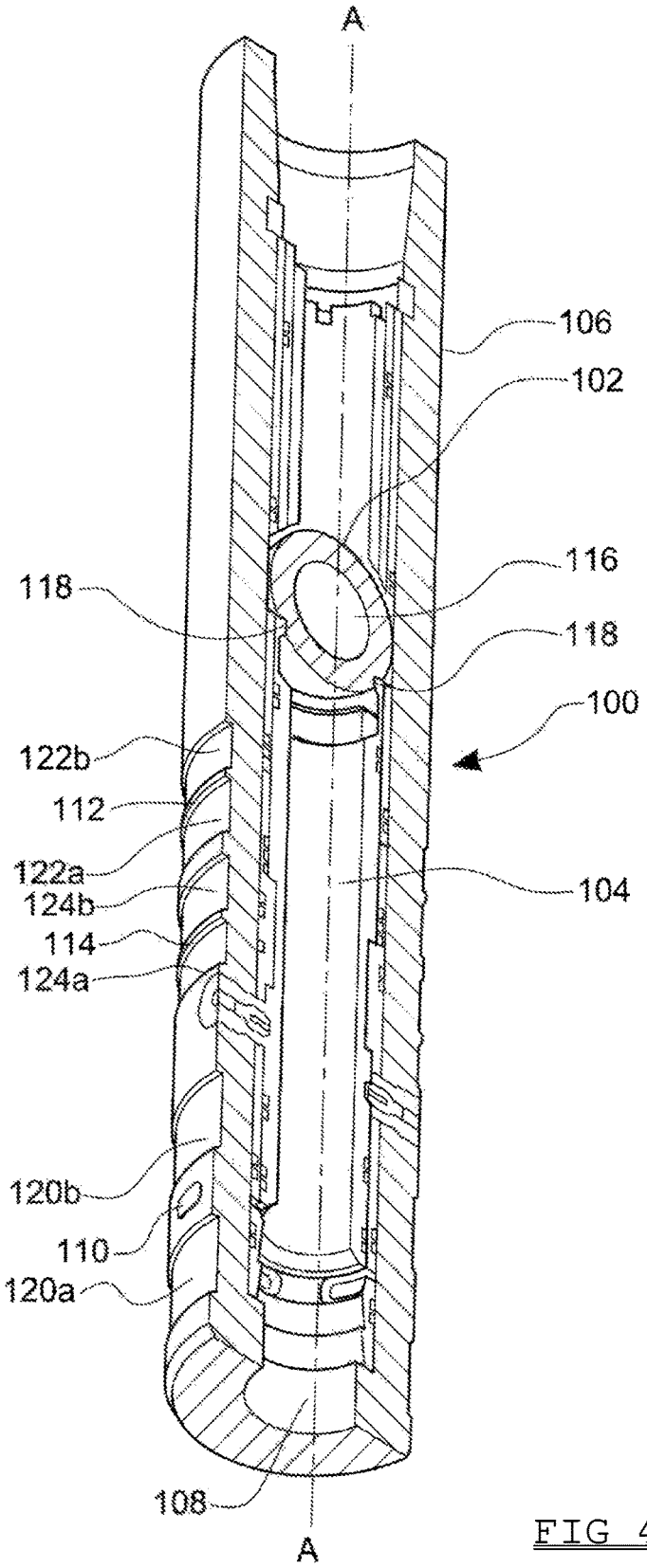
Figure 5:
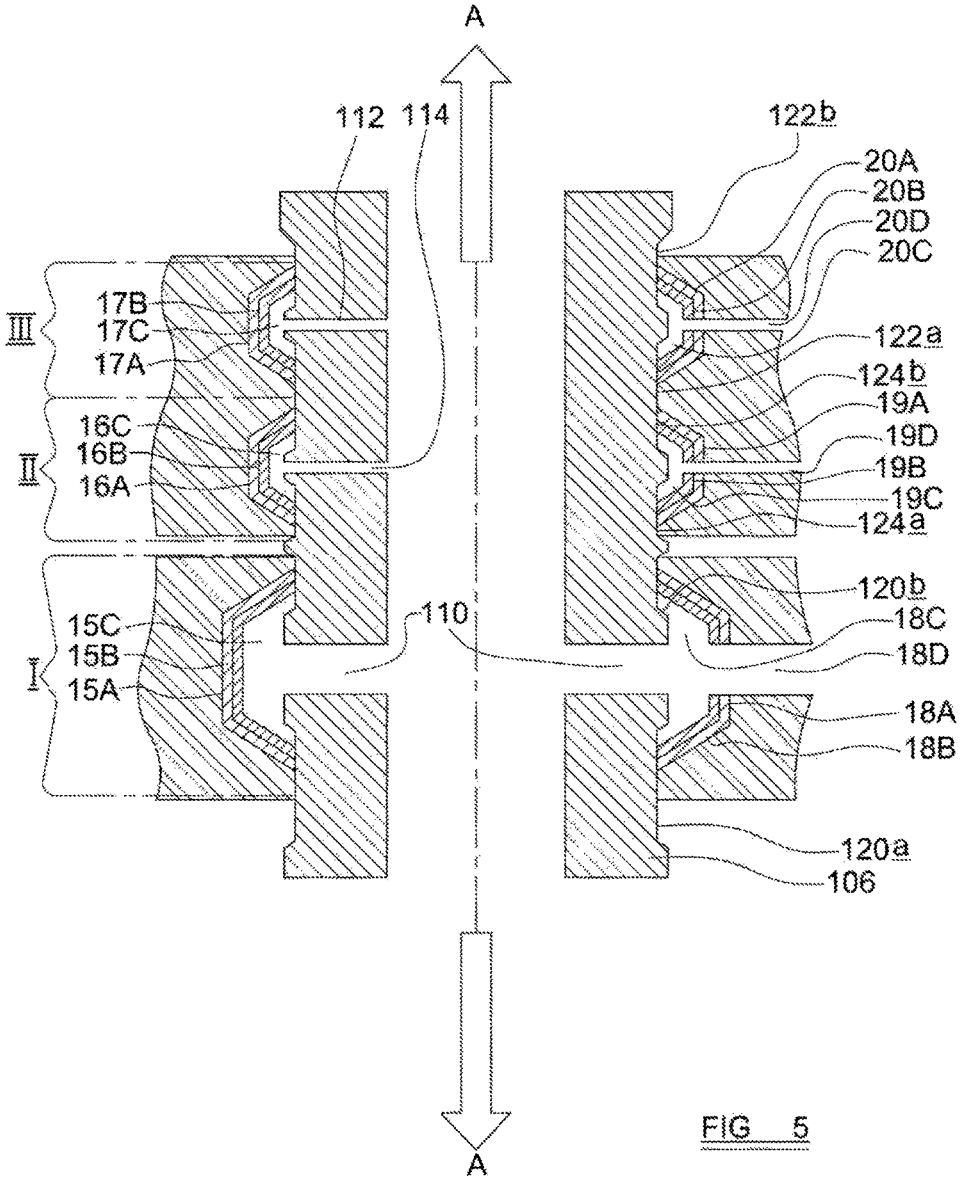
Figure 6:
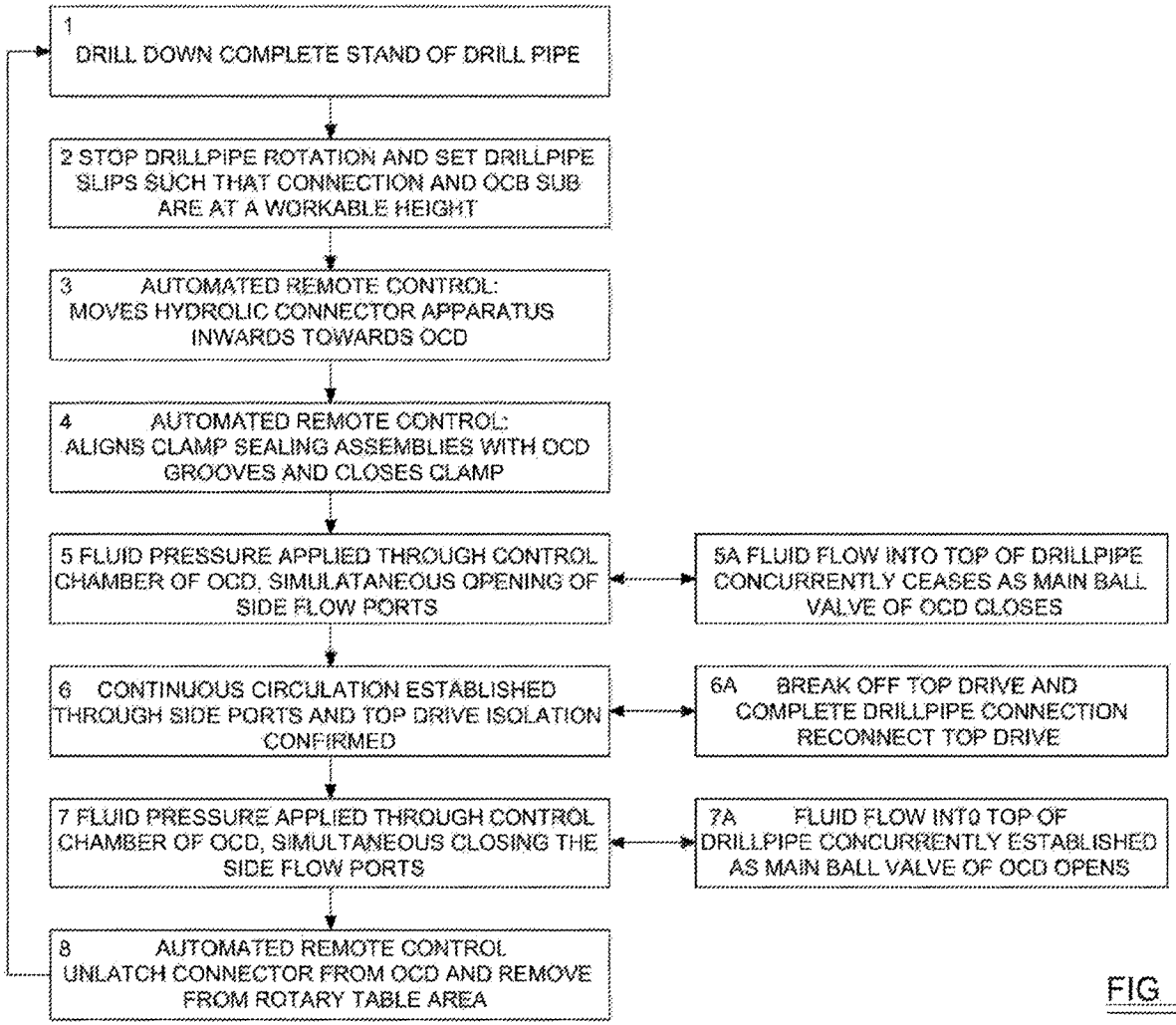

Embodiments of the invention will now be described with reference to the accompanying figures, of which FIG. 1 shows a bottom view perspective illustration of a hydraulic connector for use in the invention in its open position, FIG. 2 shows a front top view perspective illustration of the hydraulic connector shown in FIG. 1, FIG. 3 shows a rear top view perspective illustration of the hydraulic connector shown in FIGS. 1 and 2, FIG. 4 shows a perspective view of the longitudinal section of an OCD sub for use in the invention, FIG. 5 shows a schematic illustration of a cross-section through a portion of the hydraulic connector illustrated in FIGS. 1, 2 and 3 in sealing engagement with the OCD sub illustrated in FIG. 4, and FIG. 6 shows a process flow diagram for an operating methodology which may be used in conjunction with the OCD sub and hydraulic connector illustrated in FIGS. 1-5 for the completion of a connection.

Referring now to FIGS. 1, 2, and 3, there is shown a hydraulic connector which, in this embodiment is divided into three housing sections 1, 2 and 3. Section 3 is the largest housing section of the clamp, and remains stationary during the functioning of the clamp to its open and closed positions. Housing sections 1 and 2 move relative to section 3 during the open and close functions and also move in a synchronized manner with one another.

Each movable housing section 1 and 2 is pivotally mounted on section 3, in this example, by means of a pin-bushing assembly 5A, 5B, such that each section 1, 2 is rotatable relative to section 3 around the central vertical axis of its pin-bushing assembly 5A, 5B. All housing sections share a common central vertical axis when the clamp is in the closed or open position, and are, in use, supported on a vertical plane by fastening the housing sections 1, 2, 3 to a support plate 6. The support plate 6 also provides the seating and support for the steel pin-bushing assemblies 5A and 5B.

The connector is also provided with a hydraulic piston and cylinder assembly 4, and movement of the housing sections 1 and 2 relative to housing section 3 is achieved by the supply of hydraulic fluid pressure supplied to the hydraulic cylinder 4. As best illustrated in FIG. 3, the cylinder 4A is pivotally mounted on a rear end portion of housing section 1 by means of a pin and bushing assembly 7B whilst a piston rod 4B is extending from the cylinder 4A is pivotally mounted on a rear end portion of housing section 2 by means of a pin and bushing assembly 7A. The pivot axes of these pin and bushing assemblies 7A, 7B are generally parallel to the pivot axes of the pin and bushing assemblies 5A, 5B by means of which the movable housing sections 1, 2 are connected to housing section 3.

Thus, the hydraulic cylinder 4, when actuated by means of the supply of pressurised fluid to the cylinder 4A, creates a horizontal displacement between the vertical axis of pins 7A and 7B. The pins 7A and 7B also assist in supporting the weight and force of the hydraulic cylinder. This horizontal actuated motion is translated to a radial force on the movable housing sections 1 and 2, which open and close with the horizontal displacement from the hydraulic cylinder 4 with a scissor-like motion around the central vertical axis of each pin-bushing assembly 5A and 5B. This in turn closes or opens the housing sections 1, 2, 3 of the connector around a common central vertical axis.

When the connector is closed, movable housing sections 1 and 2 move inwards and engage such that they come together to form a complete circle with section 3. At this point, a sealing edge 21 of the stationary housing section 3 engages with a sealing edge 23 on movable housing section 1, a sealing edge 22 of the stationary housing section 3 engages with a sealing edge 22 on movable housing section 2, and sealing edges 25A, 25B on movable housing section 1 engages with sealing edges 26A, 26B on movable housing section 2.

The connector may be locked in the closed position, by the operation of a valve to prevent release of pressurised fluid from the hydraulic cylinder 4.

The housing sections 1, 2, 3, support plate 6 and hydraulic cylinder 4 will, in use, be mounted on a hydraulically actuated arm contained within a steel frame or cage which will be positioned and operated with a remote/assisted handling system—all aspects very similar to the Iron Roughneck used in drilling operations which is well known in the art. The connector's layout/footprint, positioning, and integration into any offshore installation will be such that it can be operated simultaneously with the rig's Iron Roughneck or tong system which connects or disconnects the drillpipe during a connection. The apparatus will be designed such that its dimensions are as compact as possible so that it can simultaneously operate with the rig's Iron Roughneck or rig tong system in a manner which will not affect or disrupt its own functionality and/or the functionality of the Iron Roughneck or tong system.

Referring now to FIG. 1, the connector also comprises three adjacent sealing assemblies (I, II, III) which are, in use, oriented along a common vertical axis but on three separate horizontal planes. Each housing section 1, 2 and 3 has a machined recess or groove 12A, 13A, 14A, 15A, 16A, 17A, 18A, 19A, 20A within its internal surface. In this embodiment, each groove 12A, 13A, 14A, 15A, 16A, 17A, 18A, 19A, 20A has a seated and secured replaceable seal insert 12B, 13B, 14B, 15B, 16B, 17B, 18B, 19B, 20B which, in this example has a U-shaped transverse cross-section. In one embodiment, each seal insert comprises a steel backing coupled with an elastomeric liner. It will be appreciated, however, that any other suitable sealing material may be used.

The seal inserts 12B, 13B, 14B, 15B, 16B, 17B, 18B, 19B, 20B are secured and locked within the grooves with internal pins 11 such that their position is fixed and their edges are flush with the internal surface 12A, 13A, 14A, 15A, 16A, 17A, 18A, 19A, 20A of the housing sections 1, 2, 3. The pins 11 substantially prevent any shifting or movement of the seal inserts 12B, 13B, 14B, 15B, 16B, 17B, 18B, 19B, 20B under pressure or force, and may be, but not limited to, threaded rods or grub screws which thread and extend through a bore in the housing and into the seal insert 12B, 13B, 14B, 15B, 16B, 17B, 18B, 19B, 20B.

In use, the movable housing sections 1, 2 are situated on the same horizontal plane as the stationary housing section 3, such that the internal sealing assembly of the stationary housing section 3 are aligned with the internal sealing assemblies of the movable housing sections 1, 2. This means that, when the connector is closed, and the three housing sections 1, 2, 3 form a complete circle, the three grooves internal surfaces in each of the three housing sections 1, 2, 3 meet to form three annular grooves (flow paths 12 C, 13C, 14C, 15C, 16C, 17C, 18C, 19C, 20C) around the internal surface of the connector. In one embodiment of connector, the stationary housing section 3 occupies a 170° portion of the circle, whilst the movable housing sections 1, 2 cover the remaining 190°.

Pressurized hydraulic or drilling fluid is, in use, supplied to each sealing assembly I, II, III through flow ports 12D, 13D, 14D, 15D, 16D, 17D, 18D, 19D, 20D extending through each housing section 1, 2, 3. Each flow port 12D, 13D, 14D, 15D, 16D, 17D, 18D, 19D, 20D extends through the internal surface of the housing sections 1, 2, 3 into one of the grooves 12A, 13A, 14A, 15A, 16A, 17A, 18A, 19A, 20A. Each seal insert 12B, 13B, 14B, 15B, 16B, 17B, 18B, 19B, 20B is provided which an aperture for each flow port 12D, 13D, 14D, 15D, 16D, 17D, 18D, 19D, 20D, each aperture having an identical cross-section to and being aligned with its respective flow port 12D, 13D, 14D, 15D, 16D, 17D, 18D, 19D, 20D so that together they form a continuous flow path from the exterior of the connector into the interior of the connector. Thus fluid flowing into any of the flow ports 12D, 13D, 14D, 15D, 16D, 17D, 18D, 19D, 20D will enter into one of the circumferential flow paths 12C, 13C, 14C, 15C, 16C, 17C, 18C, 19C, 20C.

In one embodiment of the invention each flow port 12D, 13D, 14D, 15D, 16D, 17D, 18D, 19D, 20D extends radially through the housing sections 1, 2, 3.

In one embodiment of the invention, the total number of flow ports 12D, 13D, 14D, 15D, 16D, 17D, 18D, 19D, 20D is three per sealing assembly I, II, III.

In one embodiment of the invention, the flow ports 12D, 13D, 14D, 15D, 16D, 17D, 18D, 19D, 20D for each sealing assembly I, II, III are spaced generally evenly around the circumference of the connector, one being provided in each housing section 1, 2, 3.

Conventional high pressure hydraulic couplings may be used to connect each flow port 12D, 13D, 14D, 15D, 16D, 17D, 18D, 19D, 20D with a hydraulic flow line—hose or pipe. In the embodiment of connector illustrated in FIGS. 1, 2 and 3, a portion of the hydraulic couplings 8C, 9C and pipework 8A, 8B, 9A, 9B connecting two of the three flow ports 12D, 15D for the lowermost sealing assembly I is shown. The couplings and pipework for the remaining flow ports 13D, 14D, 16D, 17D, 18D, 19D, 20D is omitted for clarity. This pipework for the hydraulic connector is preferably high pressure stainless steel pipework, which is similar in construction and mechanical properties to the conventional pipework used in the rig manifold.

The support plate 6 assists in stabilizing the housing assembly from the reactive forces exerted by the internal fluid pressure in its sealing assemblies (I, II, III) and pipework 8B, 9B, and 10B, and forces imposed by the weight of the pipework 8B, 9B, and 10B, and couplings 8C, 9C, and 10C.

Referring now to FIG. 4, there is shown an embodiment of OCD sub 100 suitable for use in the present invention. The internal workings of this sub 100 have been described in detail in co-pending patent application no. PCT/GB2011/052579. It should be appreciated, however, that the invention is not restricted for use in conjunction with this type of sub. The connector described above could equally be used with a sub with a valve assembly as described in WO2011/159983 or US2011/0308860, for example.

The OCD sub 100 comprises a ball valve 102 and sliding sleeve assembly 104 contained within a tubular body 106, which is typically, but not limited to, 3 to 4 feet in length. The tubular body 106 encloses a main flow passage 108 along the sub 100. The sub 100 is, in use, connected to the top of a drill pipe section, and may be configured such that it is compatible with whichever connection type and drill pipe size is required. The mechanical properties of the OCD sub 100 will be similar to those of the drill pipe it is connected to. The continuous circulation into the drill pipe required to allow the ECD to be maintained both inside the drill string and in the annulus during a connection may be achieved by mounting the hydraulic connector described above concentrically around the circumference of the sub 100 as will be described in more detail below.

Whilst the invention is described in connection which a sub 100 which is separate but mechanically coupled to a drill pipe, it will be appreciated that the sub 100 may be integrated into the drillpipe body itself, as described in published patent application number WO2012/010480.

In addition to the main flow passage 108, the tubular body 108 of the sub 100 is provided with a side port 110 which extends from the main flow passage 108 to the exterior of the tubular body 108, in this example, generally at right angles to a longitudinal axis A of the main flow passage 108. In one embodiment of the invention, the main flow passage 108 has a generally circular transverse cross-section, while the side port 110 has an oval shaped transverse cross-section, the major axis of the oval lying perpendicular to the longitudinal axis A.

The ball valve 102 is rotatable between an open position in which flow of fluid along the main flow passage 108 is permitted and a closed position in which the ball valve substantially prevents flow of fluid along the main flow passage 108. Movement of the ball valve 102 between the open and closed positions is achieved by sliding the sleeve assembly 104 relative to the body 106 of the sub 100 generally parallel to the longitudinal axis A.

In this preferred embodiment of the OCD the sleeve assembly 104 also forms a second, auxiliary valve member, which slides to transition between an open position in which flow of fluid through the side port 110 is permitted, and a closed position in which it substantially prevents flow of fluid through the side port 110.

The sliding sleeve 104 is hydraulically actuated by means of an actuation chamber which is provided between the sleeve 104 and the body 106 of the sub 100. Two control ports 112, 114 are provided through the body 106 into this chamber, one at each end of the chamber. The chamber is divided into two by a seal which is mounted on the exterior surface of the sleeve 104. In one embodiment of the invention, the seal comprises 2 O-rings. The seal substantially prevents flow of fluid between the two parts of the chamber while permitting the sleeve 104 to slide inside the body 106. The seal ensures that flow of pressurized fluid into the chamber via the first control port 112 causes the sleeve 104 to move towards the ball valve 102 whilst flow of pressurized fluid into the chamber via the second control port 114 acts in the opposite direction such that the effect of the pressurized fluid at the first port 40*a* is counterbalanced. The sleeve 104 therefore acts as a double acting piston with one control port 112 to move the sleeve 104 towards the ball valve 102 and one control port 114 to move the sleeve 104 away from the ball valve 102.

Although a clean hydraulic fluid is preferred for this function another fluid such as, but not limited to, a virgin base drilling fluid may be used. It is preferred for the fluid to contain minimal solids to prevent the plugging and contamination of the chamber.

The ball valve 102 has a part spherical body with a central passage 116 which extends diametrically across the generally spherical body, and two diametrically opposed circular planar surfaces (hereinafter referred to as index surfaces 118). Both the index surfaces 118 are parallel to one another and to a longitudinal axis B of the central passage 116. The ball valve 102 is mounted within the main flow passage 108 and is rotatable about axis C which is perpendicular to the longitudinal axis A of the main flow passage 108 and to the index surfaces 118.

When the ball valve 102 is in a fully open position, its central passage 116 lies generally parallel to the main flow passage 108 in the sub 100, so that fluid flowing along the main flow passage 108 travels via the central passage 116 in the ball valve 102. When the ball valve 102 is in a fully closed position, its central passage 116 lies generally perpendicular to the main flow passage 108, so the ball valve 102 blocks flow of fluid along the main flow passage 108 in the sub 100. Standard Kelly valve seals are provided between the ball valve 102 and the tubular body 106 of the sub 100 to ensure that fluid cannot flow along the main flow passage 108 around the ball valve 102.

The sliding sleeve 104 is provided with index pins which move along an index track provided in the index surfaces 118 of the ball valve 102. The index track is configured such that sliding movement of the sleeve 104 relative to the ball valve 102 rotates the ball valve 102 about its axis of rotation. Movement of the sliding sleeve 104 towards the ball valve 102 causes the ball valve 102 to rotate through 45° in a first direction, and return movement of the sliding sleeve 104 away from the ball valve 102 causes the ball valve 102 to rotate through a further 45° in the same direction.

The sub 100 is, in use, mounted in a drill string with the ball valve 102 above the side port 110.

The exterior surface of the OCD sub 100 is provided with a series of circumferential grooves—in this embodiment of the invention, 6 in total. Two grooves 120*a*, 120*b* are located on either side of the side port 110, two grooves 122*a*, 122*b* are located on either side of the first control port 112, and two grooves 124*a*, 124*b* are located on either side of the second control port 114.

In use, the connector is clamped around the OCD sub 100 such that the internal surfaces of the housing sections 1, 2, 3 in the lowermost sealing assembly I are located in the grooves 120*a*, 120*b* adjacent the side port 110, the internal surfaces of the housing sections 1, 2, 3 in the middle sealing assembly II are located in the grooves 124*a*, 124*b* adjacent the control port 114, and the internal surfaces of the housing sections 1, 2, 3 in the uppermost sealing assembly III are located in the grooves 122*a*, 122*b* adjacent the control port 114. This is illustrated in FIG. 5, in which the sliding sleeve 104 and ball valve 102 have been omitted from the OCD sub 100 for clarity.

When the hydraulic connector apparatus is positioned concentrically around the OCD housing and closed, three separate circular flow paths 12C, 13C, 14C, 15C, 16C, 17C, 18C, 19C, 20C are produced between the seal inserts 12B, 13B, 14B, 15B, 16B, 17B, 18B, 19B, 20B of each sealing assembly I, II, III and the external periphery of the OCD sub 100. When pressurised fluid is supplied to the hydraulic cylinder 4, the resulting hydraulic force acting on the cylinder 4 produces a radial force on the clamp housing which is translated to the seal inserts 12B, 13B, 14B, 15B, 16B, 17B, 18B, 19B, 20B. The outer edges of the seal inserts 12B, 13B, 14B, 15B, 16B, 17B, 18B, 19B, 20B thus provide a fluid tight seal between the connector housing sections 1, 2, 3 and the OCD sub housing, and fluid pressure may therefore be maintained in the three circular flow paths.

The lowermost sealing assembly I surrounds side port 110 utilized for continuous circulation of drilling fluid, and the other two sealing assembles II, III provide a connection to the control ports 112, 114 for hydraulically actuating the opening and closing chambers of the sliding sleeve assembly 104. In other words, the side port 110 in the OCD sub 100 is in communication with the flow path enclosed by the lowermost seal inserts 12B, 15B, 18B, the uppermost control port 112 is in communication with the flow path enclosed by the uppermost seal inserts 14B, 17B, 20B, and the other control port 114 is in communication with the flow path enclosed by the middle seal inserts 13B, 16B, 19B.

By configuring the connector to form continuous flow paths or channels around the OCD sub 100, the hydraulic connections to the control ports 112, 114 and side port 110 can be maintained, even if there is accidental rotation of the OCD sub 100 or drill string relative to the connector. The advantage to a continuous radial flow path is that it will mitigate pressurized fluid release from any unplanned or accidental rotation of the drillpipe that may occur with the drillstring during the connection. Without the described continuous flow path profile, as the pipe rotates/turns the side and control ports could be displaced from their alignment within the sealing assembly which could potentially result in a sudden release of high pressure high volume fluid to the surrounding atmosphere. With a complete circumferential seal on the external surface of the OCD, if the drillpipe accidently rotates/turns the OCD sub 100 and its side and control ports are allowed to rotate within the sealing assembly, they remain encapsulated within the sealing face. There is no break in any seal, and therefore pressurized fluid remains contained within the sealing assembly and pressure integrity is maintained.

Furthermore, the use of the described connector eliminates the requirement to stab in or connect a hose directed into the continuous circulation sub to establish continuous circulation into the drillpipe. With such a system, any unplanned or accidental drillpipe rotation during a connection would create a sudden whipping motion with the attached hose, imposing high torque forces and risking possible hose rupture. This will lead to sudden fluid and pressure release into the work area with potentially fatal consequences. Thus, the apparatus design, described herein, eliminates a direct hose connection the continuous circulation sub and its associated risks.

The split housing design of the connector may assist in distributing the forces between the tubular body 106 of the OCD sub 100 and the connector housing arising when the connector is clamped around the OCD sub 100, resulting in a more efficient and safe operation when the assembly is under internal pressure during continuous circulation. This split housing design may also provide the optimal deflection of the contact faces between the three housing sections 1, 2, 3, such that the sealing edges 21, 22, 23, 24, 25, 26 do not come apart or separate under the internal pressure the connector is subjected to during continuous circulation. Thus, the risk of the sealing edges separating and losing sealing integrity may be minimised.

The grooves 120*a*, 120*b*, 122*a*, 122*b*, 124*a*, 124*b* on the OCD sub 100 provide a guide for the correct axial location of the connector relative to the OCD sub 100, and the presence of the grooves 120*a*, 120*b*, 122*a*, 122*b*, 124*a*, 124*b* allow the accurate alignment of the connector on each respective horizontal plane such that the connector sealing assemblies I, II, III align with the three ports 110, 112, 114 of the OCD sub 100.

To summarize, the housing sections 1, 2 and 3 and inner sealing faces 21, 22, 23, 24, 25, and 26 of the connector are forced together and form the following sealing areas, with each forming their own corresponding circumferential flow path on the external surface of the OCD sub 100:

- The bottom sealing assembly (I) and its circumferential flow channel/path 12C, 15C and 18C is produced from the seal inserts 12B, 15B, and 18B against the tubular body 106 of the OCD sub 100. This sealing area encases the continuous circulation side flow port 110 of the OCD sub 100, allowing radial flow within the flow channel 12C, 15C, 18C and into the side flow ports of the OCD. Drilling fluid will be supplied to the bottom sealing assembly to achieve continuous circulation.
- The middle sealing assembly (II) and its flow channel 13C, 16C, and 19C is produced from the seal inserts 13B, 16B, and 19B against the external housing of the OCD sub 100. This sealing area encases the closing chamber flow port of the OCD sub, allowing radial flow within the flow channel 13C, 16C, 19C and into the control flow port 114 of the OCD sub 100. In use, clean hydraulic fluid will be supplied to the middle sealing assembly for operation of the OCD sub 100, but it may be possible to use a clean virgin base drilling fluid instead.
- The top sealing assembly (III) and its flow channel 14C, 17C, 20C is produced from the seal inserts 14B, 17B, 20B against the external surface of the tubular body 106 of the OCD sub 100. This sealing area encases the opening chamber flow port of the OCD sub 100, allowing radial flow within the flow channel 14C, 17C, 20C and into the uppermost control port 112 of the OCD sub 100. In use, a clean hydraulic fluid will be supplied to the top sealing assembly to operate the OCD sub 100, but it may be possible to use a clean virgin base drilling fluid instead.

The size of the seal inserts and their respective groove seats will vary depending on the magnitude of the sealing area produced by the clamp's sealing assemblies. The larger the sealed area contained within the sealing assemblies the more difficult the design will become. By designing the seal inserts such that a larger flow area results, the flow velocity will be less resulting in less erosive effects and prolonged life of the inserts. However, with larger sized grooves and seal inserts, the force of the internal pressure which is exerted across the larger sealed area and against the sealing assembly increases. Thus a larger clamp housing and hydraulic cylinder assembly is required to control the increased force to prevent face separation between the housings and loss of seal integrity.

The sequence of operation of the sub 100 is as follows. When the ball valve 102 is in its open position, the sliding sleeve 104 closes the side port 110. Pressurised fluid is then supplied to control port 114 via the ports 13D, 16D, 19D in the connector associated with the middle sealing assembly II in the OCD sub 100. This pushes the sliding sleeve 104 towards the ball valve 102, which opens the side port 110, and rotates the ball valve 102 towards its closed position. The pressure at the control port 114 is then released, and pressurised fluid is supplied to the other control port 112 via the ports 14D, 17D 20D in the connector associated with the uppermost sealing assembly III to move the sliding sleeve 104 away from the ball valve 102. The ball valve 102 rotates through a further 45° into its closed position. The index track is, however, configured to engage with the sliding sleeve to prevent it from returning to its equilibrium position in which the side port 110 is closed. The side port 110 is therefore open while the ball valve 102 is closed. Thus, this will close the ball valve 102 above the side ports 110 to isolate the fluid and high pressure in the upwards axial direction from the top drive to allow the top drive to be disconnected.

Continuous circulation may then commence by the supply of drilling fluid into the side port 110 of the OCD sub 100 via the ports 12D, 15D, 18D associated with the lowermost sealing assembly I of the connector. The drilling fluid then enters the downwards axial flow path of the drill pipe and thus continuous circulation is maintained during a connection while the hydraulic connector is engaged.

With all the external circumferential flow paths around the tubular body 106 of the OCD sub, the pressurized fluid streams are contained within the sealing assemblies I, II, III and pressure integrity is maintained around the perimeter of the OCD sub 100 between the sealing interfaces of the seal inserts 12B, 13B, 14B, 15B, 16B, 17B, 18B, 19B, 20B and the external groove 120*a*, 120*b*, 122*a*, 122*b*, 124*a*, 124*b* surfaces of the OCD sub 100.

When the connection is completed, and it is desired to close the side port 110, and re-open the ball valve 102, so that supply of drilling fluid into the drill string via the top of the drill string can be resumed, this sequence of supply of pressurised fluid to the control ports 112, 114 is repeated. The ball valve 102 rotates through a further 45° in the same direction with supply of pressurised fluid to the control port 112, and through yet a further 45° in the same direction with the supply of pressurised fluid to the control port 114. The ball valve thus returns to the open position, and the sliding sleeve 104 is released to return to its equilibrium position in which the side port 110 is closed.

The top drive may then be reconnected to the new section of drill pipe at the top of the drill string, and normal circulation of drilling fluid resumed.

Referring now to FIG. 6, there is shown a process flow diagram for the hydraulic connector during a connection period while drilling. During drilling operations, a stand of drill pipe is drilled in a downwards direction until the top tool joint connected to the top drive reaches the rotary table. The OCD sub is mounted between the top tool joint and the top drive connection. The pipe work associated with the ports 12D, 15D, 18D associated with the lowermost sealing assembly I of the hydraulic connector are connected to a drilling fluid reservoir and positive displacement pump to deliver the flow rate of drilling fluid to the side port 110 of the OCD sub 100 required to maintain the ECD during the connection.

The drill pipe rotation is stopped, and once the pipe rotation ceases the drill pipe slips are set in the rotary table such that the drill pipe hangs in the slips in the rotary table, and the connection above the OCD sub 100 are at a safe workable height for the manipulation of the Iron Roughneck and the hydraulic connector. Through automated remote controls, an operator moves the hydraulic connector inwards towards the OCD sub 100, and the sealing assemblies I, II, III are aligned with the external grooves 120*a*, 120*b*, 122*a*, 122*b*, 124*a*, 124*b* in the outer surface of the tubular body 106 of the OCD sub 100. The control ports 112, 114 and the side port 110 are aligned and contained within their respective sealing assembly I, II, III, and then the connector is hydraulically closed as described above. A hydraulic lock is remotely applied to the connector to prevent its separation under pressure.

Hydraulic fluid pressure is supplied to the control ports 112, 114 in the OCD sub 100 in the sequence described above. The sliding sleeve 104 operates to close the ball valve 102, and prevent flow in the upwards axial direction in the drillpipe and isolating the top drive. Simultaneously the continuous circulation side port 110 opens from the change in the sleeve position (5). This process is synchronized so that drilling fluid flow into the continuous circulation side port starts to increase as the drilling fluid flow into the main axial flow path of the drillpipe from the top drive above starts to decrease. Eventually the fluid flow from the top drive above ceases as the ball valve 102 moves to the fully closed position (5A) and the side port 110 fully opens.

Continuous circulation is established through the side ports via the lowermost set of ports 12D, 15D, 18D and sealing assembly I in the connector, and the top drive isolation is confirmed (6). The connection directly above the OCD sub 100 is disconnected and the top drive is removed. A new drill pipe stand with a further OCD sub attached at the top of the section is connected and torqued up into the drillstring (6A).

The sequence of supply of hydraulic fluid pressure to the control ports 112, 114 in the OCD sub 100 described above is repeated so that the sliding sleeve re-opens the ball valve to permit drilling fluid flow in the downwards axial direction from the top drive. Simultaneously the continuous circulation side port 110 closes from the change in the sleeve position (7). Again, this process is synchronized so that the drilling fluid flow through the continuous circulation side flow ports starts to decrease as the drilling fluid flow into the main axial flow path of the drillpipe from the top drive above starts to increase. Eventually the drilling fluid flow from the top drive above returns to full drilling rate as the ball valve 102 returns to the fully open position, and drilling fluid flow ceases through the OCD side port 100 when it is fully closed (7A).

Through automated remote controls the hydraulic pressure supplied to the top sealing assembly and the drilling fluid pressure in the bottom sealing assembly are bled to zero pressure. The operator uses the remote controls to hydraulically unlock and open the movable housing sections 1, 2 and disengage the hydraulic connector from the OCD sub 100. The connector is then remotely operated to move it away from the rotary table area (8). The drill pipe slips are removed and drill pipe rotation recommences—drilling continues, and this process is repeated at the next connection.

The high pressure line which supplies drilling fluid to the hydraulic connector may be fitted with a one-way non-return valve to prevent backflow of hydraulic fluid into the rig manifold system from back pressure exerted on the connector from the OCD sub 100 and drill pipe. In this way, a high pressure connection connected directly to the OCD sub 100 in the rotary table work area is eliminated, reducing the risk associated with the unplanned or accidental rotation of the drillpipe during a connection.

It will be appreciated that by using the described hydraulic connector to provide fluid supply to the OCD sub 100, the connection of the OCD sub 100 to its fluid supplies, and the operation of the OCD sub 100 required for continuous circulation drilling may be achieved remotely from a central control. As such, exposure of personnel to hazardous conditions during connection periods is minimised.

Note, for this example, the closing chamber flow port and the opening chamber flow port are the same (11). Normally, there would be two separate flow ports for the opening and closing chambers which will be located radially on different horizontal planes on the vertical axis of the OCD housing (2).

There may be multiple flow paths (9 and 10), with two illustrated in this configuration, although at least three are envisioned for optimal performance of the hydraulic connector apparatus.

In one embodiment of the invention the side port 110 comprises three separate flow ports situated on the same radial plane around a common central vertical axis within the sub 100. The total combined flow area of the ports is preferably approximately equal to the total combined flow area of the flow ports associated with the lowermost sealing assembly I of the hydraulic connector apparatus.

Various modifications may be made to the described connector and OCD sub 100 within the scope of the invention.

For example, whilst the OCD sub 100 has been described as having one side port 110, two control ports 112, 114, one or more of these ports may, in fact, comprise a group consisting of a plurality of ports distributed around the circumference of the tubular body 106 of the OCD sub 100. In this case, all of the ports within a group will be generally aligned on a single transverse plane to that they are all in communication with the circumferential flow channel formed by the respective sealing assembly I, II, III of the connector.

Similarly, it will be appreciated that, whilst in this example, the hydraulic connector is described as having three flow ports 12D, 13D, 14D, 15D, 16D, 17D, 18D, 19D, 20D into each sealing assembly I, II, III, more or fewer may be provided.

The total combined flow area of the group of flow ports 12D, 15D, 18D associated with the lower sealing assembly I in the connector is preferably such that it is approximately equal to the total combined flow area of the continuous circulation side port(s) 110 of the OCD sub 100. This will minimize friction losses during flow periods, and thus minimizes erosional effects which may occur through the ports.

Also, as mentioned above, the OCD sub 100 may not work exactly as described above. For example, it may be more similar to the one described in WO2011/159983 and US2011/0308860 in that one control port acts as a close port, supply of pressurised fluid to that port moving the sliding sleeve to close the ball valve 102 and open the side port 110, with the other control port acting as an open port, supply of pressurised fluid to that port moving the sliding sleeve to open the ball valve 102 and close the side port 110.

Two control ports 112, 114 need not be required for the operation of the OCD sub 100. For example, movement of the sliding sleeve 104 in one direction may be achieved by the supply of pressurised fluid to a control port, whilst a return spring may be provided to achieve movement of the sliding sleeve in the opposite direction. In this case, the hydraulic connector may be provided with only two sealing assemblies—one for the supply of fluid to the continuous circulation side port 110, and one for the supply of hydraulic fluid to the remaining control port.

The method of locking the hydraulic connector around the OCD sub 100 may not be exactly as described above. For example a mechanical lock may be provided to retain the housing sections 1, 2, 3 in position, clamped around the tubular body 106 of the OCD sub 100. It would be preferred, however, for such a mechanical lock to be hydraulically actuable, to retain the safety advantages associated with a completely remotely operable assembly.

It will be appreciated that the grooves 12A, 13A, 14A, 15A, 16A, 17A, 18A, 19A, 20A in the housing sections 1, 2, 3 of the hydraulic connector and the associated seal inserts 12B, 13B, 14B, 15B, 16B, 17B, 18B, 19B, 20B may not be shaped exactly as described and shown in the accompanying drawings. For example, they may be completely curved in transverse cross-section (thus having a C-shape cross-section). The important feature is that they provide a concave profile to form the circumferential flow paths around the tubular body 106 of the OCD sub 100.

Although the seal inserts 12B, 13B, 14B, 15B, 16B, 17B, 18B, 19B, 20B have been described as being separate to the housing sections 1, 2, 3, they may, in fact, be integral, thus removing the need for separate fasteners to retain them in their associated groove 12A, 13A, 14A, 15A, 16A, 17A, 18A, 19A, 20A.

Although the OCD sub 100, hydraulic connector, and associated pipework is typically made from steel, it will be appreciated that any high strength materials could be used for the fabrication of any aspects of these apparatus.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An apparatus for continuous circulation drilling comprising a tubular body having a main passage extending along a longitudinal axis of the tubular body from a first end of the tubular body to a second end of the tubular body, a side passage and a control passage, the side passage and control passage both extending through the tubular body into the main passage, the tubular body containing a valve assembly which is operable to close the main passage when the side passage is open and to close the side passage when the main passage is open, the assembly further comprising a hydraulic connector which is operable to clamp around the tubular body, the connector comprising a housing with an interior surface which is provided with first and second grooves which, when the connector is clamped around the tubular body, each form a channel which extends in continuous loop around the exterior of the tubular body, there being at least one passage extending through the housing from an exterior surface of the housing into each of the channels, wherein, the tubular body is further provided with at least one groove which extends around an exterior surface of the body so that, when the connector is clamped around the tubular body, the connector housing engages with the at least one groove of the tubular body so that the first and second grooves of the connector housing each overlap with the at least one groove of the tubular body, the at least one groove thus restricting a longitudinal movement of the connector relative to the tubular body, and the side passage and control passage each connect the main passage with one of the channels formed by the connector, wherein, the housing of the connector comprises a first housing section, a second housing section, and a third housing section, the first housing section and the second housing section are pivotally mounted on the third housing section, and, during an opening and a closing of the connector, the third housing section remains stationary and the first housing section and the second housing section move relative to the third housing section, wherein, the apparatus is further provided with sealing elements which, when the connector is clamped around the tubular body, form a seal between the connector and the tubular body, and wherein, the sealing elements form at least three seals, each of which forms a continuous loop around the tubular body, the first seal lying between the first end of the tubular body and the control passage, the second seal lying between the control passage and the side passage, and the third seal lying between the side passage and the second end of the tubular body.

2. An apparatus according to claim 1 wherein the groove extends in a loop around the entire circumference of the tubular body.

3. An apparatus according to claim 1 wherein the valve assembly comprises a rotating valve member which is rotatable to open or close the main passage in the tubular body.

4. An apparatus according to claim 1 wherein the valve assembly comprise a sliding sleeve which is located in the main passage of the tubular body and which is movable generally parallel to the longitudinal axis of the tubular body by a supply of pressurised fluid to a control port, the sliding sleeve being connected to a rotating valve member so that such longitudinal movement of the sliding sleeve causes the rotating valve member to rotate.

5. An apparatus according to claim 4 wherein, during this longitudinal movement, the sliding sleeve moves from a first position in which it closes the side passage in the tubular body, and a second position in which the side passage is open.

6. An apparatus according to claim 1 wherein the tubular body is provided with a further control passage which extends through the tubular body into the main passage, and the interior surface of the connector may be provided with a third groove which, when the connector is clamped around the tubular body, forms a third channel which extends in continuous loop around the exterior of the tubular body.

7. An apparatus according to claim 6 wherein sealing elements are provided to form at least four seals, each of which forms a continuous loop around the tubular body, the first seal lying between the first end of the tubular body and the first control passage, the second seal lying between the first control passage and the second control passage, the third seal lying between the second control passage and the side passage, and the fourth seal lying between the side passage and the second end of the tubular body.

8. An apparatus according to claim 1 wherein the sealing elements include at least one seal insert which lines one of the grooves in the interior surface of the connector.

9. An apparatus according to claim 1 wherein the first housing section, the second housing section and the third housing section are each provided with sealing surfaces which, when the connector is clamped around the tubular body, engage with sealing surfaces of an adjacent housing section to seal between adjacent housing sections.

10. An apparatus according to claim 1 wherein the connector is provided with an actuator for pivoting the first housing section and the second housing section relative to the third housing section.

11. An apparatus according to claim 10 wherein the actuator comprises a hydraulically operated piston and cylinder.

12. An apparatus for continuous circulation drilling comprising a tubular body having a main passage extending along a longitudinal axis of the tubular body from a first end of the tubular body to a second end of the tubular body, a side passage and a control passage, the side passage and control passage both extending through the tubular body into the main passage, the tubular body containing a valve assembly which is operable to close the main passage when the side passage is open and to close the side passage when the main passage is open, the assembly further comprising a hydraulic connector which is operable to clamp around the tubular body, the connector comprising a housing with an interior surface which is provided with first and second grooves which, when the connector is clamped around the tubular body, each form a channel which extends in continuous loop around the exterior of the tubular body, there being at least one passage extending through the housing from an exterior surface of the housing into each of the channels, wherein, the tubular body is further provided with at least one groove which extends around an exterior surface of the body so that, when the connector is clamped around the tubular body, the connector housing engages with the at least one groove of the tubular body so that the first and second grooves of the connector housing each overlap with the at least one groove of the tubular body, the at least one groove thus restricting a longitudinal movement of the connector relative to the tubular body, and the side passage and control passage each connect the main passage with one of the channels formed by the connector, wherein, the connector housing comprises a first housing section, a second housing section, and a third housing section, the first housing section and the second housing section being pivotally mounted on the third housing section, and, during an opening and a closing of the connector, the third housing section remains stationary and the first housing section and the second housing section move relative to the third housing section.

13. An apparatus according to claim 12 wherein the connector is provided with an actuator for pivoting the first housing section and the second housing section relative to the third housing section.

14. An apparatus according to claim 13 wherein the actuator comprises a hydraulically operated piston and cylinder.

15. An apparatus according to claim 12 wherein the first housing section, the second housing section, and the third housing section are each provided with sealing surfaces which, when the connector is clamped around the tubular body, engage with sealing surfaces of an adjacent housing section to seal between adjacent housing sections.

* * * * *